US010429063B2

(12) United States Patent
Shah et al.

(10) Patent No.: US 10,429,063 B2
(45) Date of Patent: Oct. 1, 2019

(54) SMART ALGORITHM TO DETERMINE "STEAM BOILER WATER CONDITION"

(71) Applicant: Fluid Handling LLC, Morton Grove, IL (US)

(72) Inventors: Pratik N. Shah, Des Plaines, IL (US); James J. Gu, Buffalo Grove, IL (US)

(73) Assignee: Fluid Handling LLC, Morton Grove, IL (US)

( * ) Notice: Subject to any disclaimer, the term of this patent is extended or adjusted under 35 U.S.C. 154(b) by 88 days.

(21) Appl. No.: 15/417,612

(22) Filed: Jan. 27, 2017

(65) Prior Publication Data

US 2017/0234527 A1 Aug. 17, 2017

Related U.S. Application Data

(60) Provisional application No. 62/287,727, filed on Jan. 27, 2016.

(51) Int. Cl.
*F22B 35/18* (2006.01)

(52) U.S. Cl.
CPC ..... *F22B 35/18* (2013.01)

(58) Field of Classification Search
CPC ..... F22B 35/18
See application file for complete search history.

(56) References Cited

U.S. PATENT DOCUMENTS 1,977,898 A * 10/1934 Seniff ..... F22B 37/42 122/379
2,875,156 A * 2/1959 Johnson ..... B01B 1/04 516/134
5,600,997 A 2/1997 Kemp et al.
5,611,241 A 3/1997 Henry et al.
(Continued)

FOREIGN PATENT DOCUMENTS

CN 1800792 A 5/2006
WO 2011131837 A1 10/2011

OTHER PUBLICATIONS

TDS control: Spriax Sarco, accessed on Jun. 24, 2018, with a priority date shown of Mar. 26, 2015.*
(Continued)

*Primary Examiner* — Nathaniel Herzfeld

(74) *Attorney, Agent, or Firm* — Ware, Fressola, Maguire & Barber LLP

(57) ABSTRACT

A technique for determining a boiler water condition includes a boiler controller (aka PSE unit) having a signal processor that implements a boiler control algorithm to receive signaling containing information about sets of N consecutive probe data samples related to a boiler water condition; determine stable average signaling containing information about a stable average by averaging a set of N consecutive probe data samples in the signaling received; determine present stable average signaling containing information about a present stable average by averaging a present set of N consecutive probe data samples in the signaling received; and determine corresponding signaling containing information about the boiler water condition, based upon whether the present stable average is within an allowable limit and a comparison of the present and previous stable average signaling determined.

17 Claims, 2 Drawing Sheets

(56) References Cited

U.S. PATENT DOCUMENTS

| | | | | |
|---|---|---|---|---|
| 5,739,504 | A | 4/1998 | Lyons et al. | |
| 6,390,027 | B1 | 5/2002 | Lyons et al. | |
| 6,666,086 | B2 | 12/2003 | Coleman et al. | |
| 6,688,329 | B2 | 2/2004 | Murray et al. | |
| 6,904,800 | B2 * | 6/2005 | Merwin | G01F 23/243 340/620 |
| 6,918,356 | B2 | 7/2005 | Rowe et al. | |
| 7,243,540 | B2 | 7/2007 | Merwin | |
| 7,249,573 | B2 | 7/2007 | Kemp et al. | |
| 7,317,993 | B2 * | 1/2008 | Merwin | G01F 23/0061 702/55 |
| 7,409,301 | B2 | 8/2008 | Tynkov | |
| 7,436,187 | B2 | 10/2008 | Thompson | |
| 7,500,453 | B2 | 3/2009 | Lindberg | |
| 7,706,989 | B2 | 4/2010 | Merwin et al. | |
| 7,891,572 | B1 | 2/2011 | Murray | |
| 8,521,495 | B2 | 8/2013 | Ray et al. | |
| 8,756,992 | B2 | 6/2014 | Bogdanchik | |
| 9,121,607 | B2 | 9/2015 | Labbe et al. | |
| 2005/0043907 | A1 | 2/2005 | Eckel et al. | |
| 2006/0152225 | A1 * | 7/2006 | Thomson | G01F 23/241 324/446 |
| 2008/0109176 | A1 | 5/2008 | Merwin et al. | |
| 2012/0010845 | A1 | 1/2012 | Bohan et al. | |
| 2013/0269416 | A1 | 10/2013 | Myrick et al. | |
| 2013/0277440 | A1 | 10/2013 | Cohen | |
| 2014/0136127 | A1 | 5/2014 | Sanchez et al. | |

OTHER PUBLICATIONS

English language abstract of CN1800792.

Kun Yang, "Industrial boiler feed water system of smart regulation," Topresearch, research001.com, Master thesis, Liaoning Technical Univ, 2005 (2 pages). http://www.research001.com/?showinfo-31-86485-0.html.

Draper, Phil, "Limit Controls for Steam and Hot Water Boilers," Gems Sensors & Controls, gemssensors.com, accessed Feb. 2016 (4 pages). http://www.gemssensors.com/~/media/GemsNA/Brochures/limit-controls-for-steam-and-hot-water-boilers.ashx.

Improved Boiler Performance and Optimization with Infra-View® Boiler Thermometer, Infra-View®, Infra-view.com, accessed Feb. 2016 (5 pages). http://www.infra-view.com/Boiler-Thermometer/Tech-Paper.

AQ25A44B/U, Honeywell, customer.honeywell.com, accessed: Feb. 2016 (2 pages). https://customer.honeywell.com/en-US/pages/product.aspx?cat=HonECC%20Catalog&pid=AQ25A44B/U.

* cited by examiner

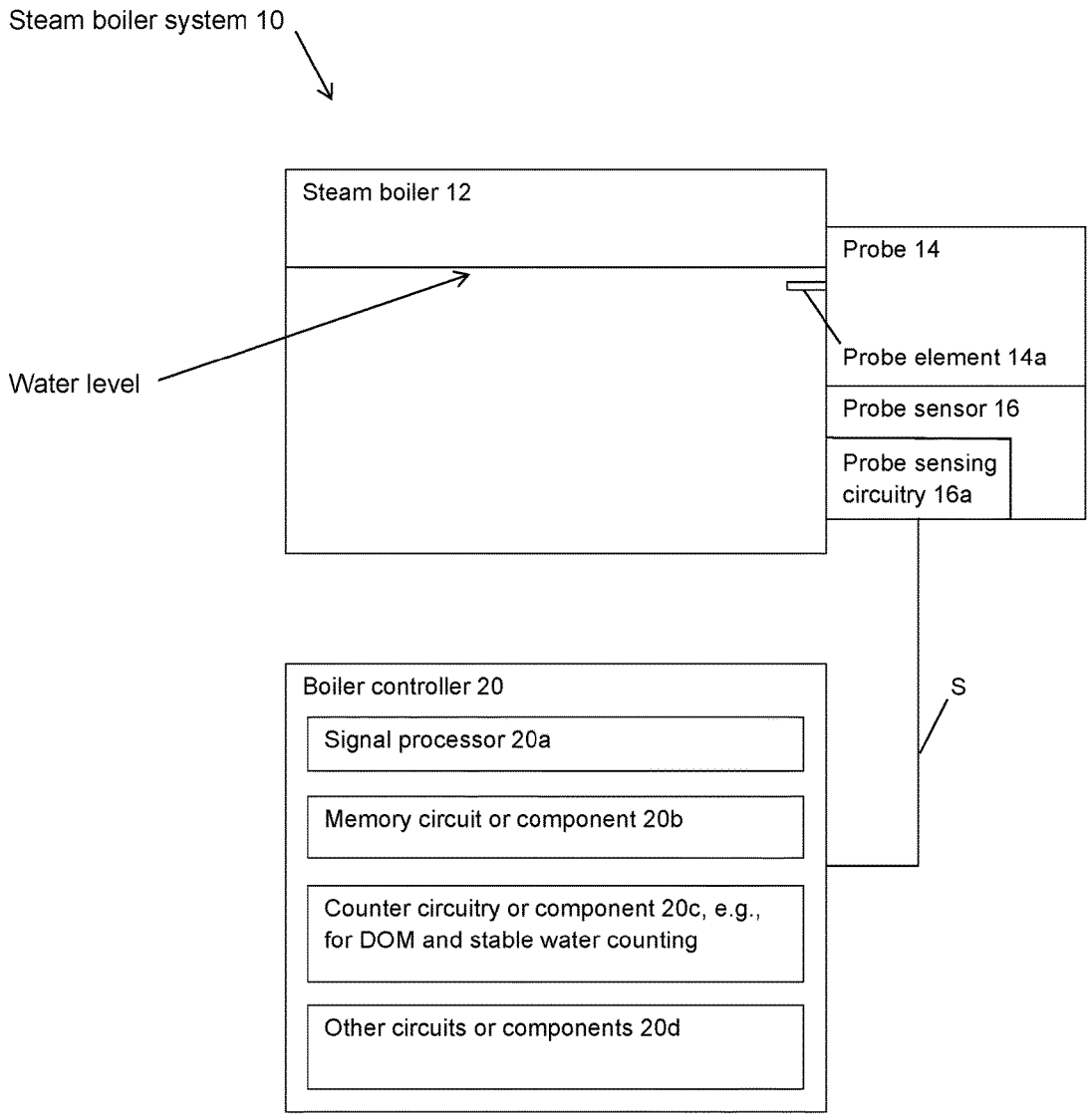
Figure 1: Steam Boiler System 10

Steam boiler control algorithm 30

A. Turn on the probe steam enhancement (PSE) unit (e.g., which may include, or take the form of, the boiler controller 20 (Fig. 1) for implementing the boiler control algorithm in Fig. 2)).

B. If the PSE unit senses and determines that the probe 14 is in an in-water condition, then the PSE unit starts a counter 20c for counting to DOM and turns the steam boiler 12 ON.

C. Once Boiler/Burner 12 is ON, the PSE unit takes and averages "N" consecutive probe data samples and sets a stable average, e.g., based upon the same.

D. The PSE unit takes and averages the next "N" consecutive data samples, determines a present sample average, and compares the present sample average with the "Stable average" determined in step C. If the present sample average determined in step D is within an allowable limit (+/-), then the PSE unit increments a stable water counter 20c and rewrites the stable average with the present sample average determined.

F. If the PSE unit determines that any data is out of the allowable limits (+/-) while comparing present average and stable average during the step D, then the PSE unit reset the stable water counter 20c, which will start counting from 0.

G. Once the stable water counter 20c reaches a count of "M", the PSE unit sets the foam threshold as the last average data sampled plus an offset.

H. Once the water is determined to be stable, the PSE unit uses the probe 14 and probe sensor 16 to sense, e.g., three consecutive probe data samples, and verifies if any of the consecutive probe data samples cross the foam threshold before starting the foam algorithm. The PSE unit starts the present foam algorithm only if this consecutive probe data sample condition is satisfied.

Figure 2: Boiler Control Algorithm 30

SMART ALGORITHM TO DETERMINE "STEAM BOILER WATER CONDITION"

CROSS-REFERENCE TO RELATED APPLICATION

This application claims benefit to provisional patent application Ser. No. 62/287,727, filed 27 Jan. 2016, which is hereby incorporated by reference in its entirety.

BACKGROUND OF THE INVENTION

1. Field of the Invention

The present invention relates to a technique for determining a boiler water condition; and more particularly to a technique for monitoring and controlling a steam boiler water condition based upon the determination.

2. Brief Description of Related Art

The present PSE (Probe Steam Enhancement (aka "PS-Enhancement")) unit uses a model foam detection algorithm that averages water sample data over a period of time and compares each average sample data in an incremental manner with past sample data by a fixed constant. If this process is valid for four consecutive average data samples, then the system declares a foam condition in the boiler. This averaging algorithm for foam detection starts as soon as the boiler unit is turned ON.

The present foam detection algorithm has a number of limitations/constraints that creates a faulty/irregular shutdown of boilers. By way of example, the limitations are as follows:

A. Probe resistance continuously varies inside the boiler due to the waves when the water starts boiling. By averaging the data, sometimes the system satisfies the present foam condition algorithm and shuts down the boiler irregularly.

B. While feeding the cold water during a boiler out-of-water condition, the water resistance starts increasing (e.g., cold water has high resistance and hot water has low resistance). Change in water resistance will vary/increase the probe data. By averaging these incremental data samples, sometimes the system satisfies the present foam condition algorithm and shuts down the boiler irregularly.

C. When the water inside the boiler heats up, it will start to foam or create a bubble/foam. Checking water resistance in such a condition will give varying data samples. By averaging such varying data samples, sometimes the system satisfies the present foam condition algorithm and shuts down the boiler irregularly.

D. In small boilers, the water level goes down rapidly in comparison to large and medium sized boilers. In such cases, the probe resistance starts increasing due to the fast change in the water level. Such incremental change in water resistance sometimes satisfies the present foam condition algorithm and shuts down the boiler irregularly.

All above conditions create a faulty shutdown of boilers without any actual foam condition. To overcome such limitations, an algorithm has to be defined to measure water quality to calculate a foam threshold and start the foam condition algorithm when there is a continuous drop in water level. Change in water resistance is affected due to following parameters:

1. Size of Boiler—Large, Medium and Small size boilers;
2. Water Quality—Pure, with salt/conductive chemicals;
3. Hot or Cold water; and
4. Size of the water bubbles—When water heats-up.

In view of the aforementioned problems in the art, there is a need to provide a better way to detect and respond to such steam boiler water conditions.

Detail Explanation of Each Point is Given Above

The following is a detailed explanation of each of the aforementioned points:

A. Size of Boiler: Boilers are of a different size (Small, Medium and Large) depending upon the application. Change in the water level in a small sized boiler is typically much faster compared to a large sized boiler. If the foam algorithm starts reacting on the change in water level, then the system will encounter irregular tripping or boiler shutdown without a foam condition. To avoid such a condition, a water stability algorithm needs to be determined that takes this change in the water level into account.

B. Water Quality: Need to start the foam condition once the probe data has crossed the fixed threshold. This will allow the foam algorithm to start once the probe data crosses the fixed threshold and allow the system to work on an actual foam condition. Water quality is an important parameter which varies depending upon the geographical location of the boiler and its application. By keeping a fixed foam threshold, the system will work for few applications (For example, for pure water applications for food processing, or for adding salt/chemicals for industrial applications) or some geographical locations but may not be true for all applications or locations. To cater to such conditions, the water quality check algorithm needs to be defined which will check the water quality dynamically and adjusts the water threshold as per the application and geographical location.

C. Hot or Cold water: During the water feeding process, cold water will get added in existing hot water in the boiler. Since cold water resistance is higher than hot water resistance, this will increase the water resistance and allows the probe data to change. When the water level is low, the water feeder will start feeding cold water to the boiler, and it will get mixed with the existing hot water. The present foam algorithm will start reacting to the change in resistance from the first drop of cold water added to the boiler. This needs to be avoided, e.g., and may be resolved by allowing water to stabilize the boiler every time when the boiler trips.

D. Water bubble size: When water heats inside the boiler, water bubbles start to foam which is nothing but foam. These bubbles are of different size and of different resistance depend upon the water content. Such bubbles sensed by the probe will change the probe resistance and will cause or allow the present foam algorithm to start reacting without any consideration to the water level. Also the present foam algorithm is activated from the moment the boiler starts to operate. To solve this issue, an algorithm needs to be defined to check the drop in water level consecutively before starting the foam algorithm. This will make sure that the water level is below the probe.

SUMMARY OF THE INVENTION

In summary, the present invention takes into account both the aforementioned problems in the art and points recognized by the inventors, and provides a new and better way to detect and respond to such steam boiler water conditions.

By way of example, and according to some embodiments, the present invention takes the form of a new and unique boiler controller for determining a boiler water condition featuring a signal processor configured to implement a boiler control algorithm to:

receive signaling containing information about sets of N consecutive probe data samples related to the boiler water condition;

determine stable average signaling containing information about a stable average by averaging a set of N consecutive probe data samples in the signaling received;

determine present stable average signaling containing information about a present stable average by averaging a present set of N consecutive probe data samples in the signaling received; and determine corresponding signaling containing information about the boiler water condition, based upon whether the present stable average is within an allowable limit and a comparison of the present stable average signaling and the stable average signaling.

The boiler controller may also include one or more of the following features:

The signal processor may be configured to implement the boiler control algorithm to determine if the present stable average is within the allowable limit, then increment a stable water counter and rewrite the stable average signaling with the present stable average signaling, else declare a foam condition as the boiler water condition and reset the stable water counter.

The signal processor may be configured to implement the boiler control algorithm to repeat for M sets of the N consecutive probe data samples the following:

determine if the present stable average is within the allowable limit based upon the comparison of the present stable average signaling and the stable average signaling; and if the present stable average is within the allowable limit, then increment the stable water counter and rewrite the stable average signaling with the present stable average signaling, else declare a foam condition and resetting the stable water counter.

The signal processor may be configured to determine if any data sample is out of the allowable limits (+/−) while comparing present average and stable average, then the stable water counter will get reset and will start counting from 0.

The signal processor may be configured, once the stable water counter reaches to a count "M", to set a new foam threshold as a last average data plus an offset.

The signal processor may be configured, once the water is stable, to sense the probe for consecutive probe data samples and verify if any crosses the foam threshold before starting the foam algorithm and start a present foam algorithm only if this condition is satisfied.

According to some embodiments, the present invention may take the form of a method for determining the boiler water condition, featuring steps for:

receiving in a signal processor signaling containing information about sets of N consecutive probe data samples of the boiler water condition;

determining in the signal processor stable average signaling containing information about a stable average by averaging a set of N consecutive probe data samples in the signaling received;

determining in the signal processor present stable average signaling containing information about a present stable average by averaging a present set of N consecutive probe data samples in the signaling received; and determining corresponding signaling containing information about the boiler water condition, based upon whether the present stable average is within an allowable limit and a comparison of the present stable average signaling and the stable average signaling.

The method may include, or take the form of, implementing the boiler control algorithm according to the present invention. The method may also include one or more steps for implementing one or more of the other features disclosed herein.

By way of example, advantage of the new boiler control algorithm may include:

1. A water stability check, e.g., that takes in account a change in the water level.
2. A water quality check, e.g., that checks and takes into account the water quality dynamically and adjusts the water threshold, e.g., as per the boiler application and geographical location.
3. A consecutive level water drop check, e.g., to check the drop in water level consecutively, e.g., before starting the foam algorithm.

BRIEF DESCRIPTION OF THE DRAWING

The drawing includes the following Figures, not necessarily drawn to scale, including:

FIG. 1 is a block diagram of a boiler system, according to some embodiments of the present invention.

FIG. 2 is a diagram of a flow chart for implementing steps A through H, according to some embodiments of the present invention.

In the Figures, similar parts are labeled with similar reference numerals. Moreover, not every part is labelled with a reference numeral and lead line in every Figure, so as to reduce clutter in the drawing.

DETAILED DESCRIPTION OF THE INVENTION

FIG. 1

By way of example, and according to some embodiments of the present invention, FIG. 1 shows a steam boiler system generally indicated as 10 having a steam boiler 12 arranged or configured in relation to a probe 14 with a probe element 14*a* and a probe sensor 16 with probe sensing circuitry 16*a*, as well as a boiler controller 20 for implementing a boiler control algorithm for controlling the steam boiler 12. The boiler controller 20 may include, or form part of, a PSE unit, e.g., consistent with that set forth herein. By way of example, the boiler controller 20 may include a signal processor 20*a* arranged in relation to a memory circuit or component 20*b* and a counter circuit or component 20*c* for implementing DOM and stable water counting functionality. Associated signaling S may be exchanged between the boiler controller 20 and the probe sensing circuitry 16*a*, e.g., as shown in FIG. 1. The boiler controller 20 may also include other circuits or components generally indicated as 20*d*, e.g., including input/output circuitry or components, data and control bus circuitry or components, as well as other circuitry or components to implement the signal processing functionality disclosed herein. Further, in the boiler controller 20 all of the circuits or components 20*b*, 20*c*, 20*d* are understood to be suitably coupled together for providing a suitable signaling exchange to/from the signal processor 20*a* for implementing the signal processing functionality disclosed herein.

Algorithm to Overcome Prior Art Foam Algorithm Limitations

The present invention takes into account and implements a new boiler control algorithm generally indicated as 30 in FIG. 2 having steps A through H, which includes a water stability check, a dynamic water quality check and a consecutive water level drop check, e.g., consistent with that set forth below:

A. Turn on the PSE unit.

Water Stability Check

B. If the boiler's probe 14 is in an in-water condition, the boiler controller 20 in the steam boiler system will start a counter like counter 20*c* (see FIG. 1) for counting to a Delay on Make (DOM) count and will turn the boiler ON upon reaching the DOM count. By way of example, in operation the steam boiler system 10 may include the boiler controller 20 configured to implement the new boiler control algorithm to receive probe sensing signaling containing information that the boiler's probe 14 is immersed in the boiler's water, and provide controller signaling to start the counter 20*c* to count to the DOM count. Upon reaching the DOM count, the boiler controller 20 will provide controller signaling to turn the steam boiler 12 ON. The DOM count is a counter or number, e.g. that is predetermined depending on the particular boiler application and may be set in the boiler controller 20, e.g., as one skilled in the art would appreciate.

Dynamic Water Quality Check

C. Once the steam boiler or burner 12 is ON, "N" consecutive probe data samples will be averaged and will be set as a stable average. By way of example, in operation the boiler controller 20 may be configured to implement the new boiler control algorithm to provide control signaling to actuate the probe sensor 16 and sense the probe 14, receive probe data signaling from the probe sensor 16 containing information about the "N" consecutive probe data samples, and provide further control signaling to store consecutive probe data signaling containing information about the "N" consecutive probe data samples, e.g., in the memory 20*b* (FIG. 1). Further, the boiler controller 20 may also be configured to receive memory signaling containing information about the "N" consecutive probe data samples (e.g., stored in the memory 20*b* (see FIG. 1)), process the memory signaling to determine stable average signaling containing information about the stable average, and store the stable average signaling in the memory 20*b* as a set stable average.

D. Next "N" consecutive data samples will then be averaged and will be compared with the set "Stable average". If the present (i.e., next) stable average is within an allowable limit(s) (or variation), then increment a stable water counter 20*c* and rewrite the stable average with the present stable average. By way of example, in operation the boiler controller 20 may be configured to implement the new boiler control algorithm, e.g., consistent with that set forth in step C, to sense the probe 14 and determine next "N" consecutive data sample signaling containing information about the next "N" consecutive data samples, which may then be stored in memory 20*b*. Moreover, the boiler controller 20 may be configured to implement the new boiler control algorithm to provide control signaling to receive memory signaling containing information about the next "N" consecutive probe data samples (e.g., stored in a memory 20*b*), process the next "N" consecutive probe data samples to obtain next stable average signaling containing information about the next stable average, compare the next stable average to the set stable average (e.g., stored and received back from in the memory 20*b*), and determine if the next stable average is within the allowable limit. If the boiler controller 20 determines that the next (i.e., present) stable average is within the allowable limit, then the boiler controller 20 provides control signaling to increment the counter 20*c* for stable water counting, rewrite the stable average signaling with the next stable average signaling, e.g., which may be stored in the memory 20*b*. The boiler controller 20 may also be configured to determine corresponding signaling containing information about the steam boiler water condition, e.g., based upon whether the present stable average is within an allowable limit and a comparison of the present stable average signaling and the stable average signaling. The corresponding signaling may take the form of, or may include, control signaling to continue to implement the new boiler control algorithm to further monitor or evaluate the steam boiler water condition, e.g., including to shut down the boiler system consistent with that set forth herein. By way of further example, the "allowable limit" may include, or take the form of, an allowable standard deviation, e.g., which may be determined depending on the boiler application. The scope of the invention is not intended to be limited to any particular allowable limit, e.g., small boiler applications may have one allowable limit, large boiler applications may have another allowable limit, and intermediate boiler applications may have still another allowable limit, as one skilled in the art would appreciate.

E. The boiler controller 20 in the steam boiler system 10 may be configured to implement the new boiler control algorithm to repeat at least step D for "M" sets of data samples.

F. If any data sample is out of the allowable limits (+/−) while comparing present average and stable average during the step D, then the stable water counter 20*c* will get reset and will start counting from 0. By way of example, in operation the boiler controller 20 may be configured to implement the new boiler control algorithm to determine if any next (i.e., present) stable average is out of the allowable limits (+/−) while comparing the next stable average signaling and the set stable average signaling during the step D; and if so, then the boiler controller 20 may be configured to provide control signaling, e.g., to reset the stable water counter 20*c* to start counting from 0.

Consecutive Water Level Drop Check

G. Once the stable water counter 20*c* reaches to a count "M", the last average data plus an offset will be set as a new foam threshold. By way of example, in operation the boiler controller 20 may be configured to implement the new boiler control algorithm to receive stable water counter signaling containing information that the stable water counter 20*c* reached the count "M", and provide foam threshold signaling containing information about the last stable average data sample plus an offset to set as the foam threshold, e.g., which may be stored in the memory 20*b*. The scope of the invention is not intended to be limited to any particular so-called offset, e.g., small boiler applications may have one offset. large boiler applications may have another offset, and intermediate boiler applications may have still another offset, as one skilled in the art would appreciate. Moreover, the count M is a counter or number, e.g. that is predetermined depending on the particular boiler application and may by set in the boiler controller 20, e.g., as one skilled in the art would appreciate.

H. Once the water is stable, the probe 14 will sense, e.g., three consecutive probe data samples and verify if any crosses the foam threshold before starting the foam algorithm. The present foam algorithm will start only if this condition is satisfied. By way of example, in operation the boiler controller 20 may be configured to implement the new boiler control algorithm and provide control signaling to actuate the probe sensor 16 to sense the some consecutive number of probe data samples (e.g., 3), receive consecutive probe data sample signaling containing information about the consecutive probe data samples, process the consecutive probe data sample signaling, compare the consecutive probe data sample signaling to foam threshold signaling containing information about the foam threshold to verify if the consecutive probe data crosses the foam threshold, e.g., before starting the foam algorithm of the new boiler control algorithm. The scope of the invention is not intended to be limited to any particular so-called foam algorithm. The scope of the invention is intended to include, and embodiments are envisioned using, foam algorithms that are both now known in the art, and later developed in the future.

TABLE

The following is a table showing field validation reports:
Software - Field Validation Report

| Sr. No | Client Name | Date | Part Number | Location | Customer Feedback |
|---|---|---|---|---|---|
| 1 | Client 1 | Date 1 | 153827 | Client 1 Address | Works well. NO issues found |
| 2 | Client 1 | Date 1 | 153827 | Client 1 Address | Works well. NO issues found |
| 3 | Client 2 | Date 1 | 153827 | | Works well. NO issues found |
| 4 | Client 3 | Date 2 | 153827 | | All Units are working good |
| 5 | Client 3 | Date 2 | 153827 | | |
| 6 | Client 3 | Date 2 | 153827 | | |
| 7 | Client 3 | Date 2 | 153827 | | |
| 8 | Client 1 | Date 3 | 153827 | Client 1 Address | Works well. NO issues found |
| 9 | Client 3 | Date 4 | 153927 | | All units are working good for client 3 |
| 10 | Client 3 | Date 4 | 153927 | | |
| 11 | Client 3 | Date 4 | 153927 | | |
| 12 | Client 3 | Date 4 | 153927 | | |
| 13 | Client 3 | Date 4 | 153927 | | |
| 14 | Client 3 | Date 4 | 153927 | | |
| 15 | Client 3 | Date 4 | 153927 | | |
| 16 | Client 3 | Date 4 | 153927 | | |
| 17 | Client 3 | Date 4 | 153927 | | |

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawing herein is not drawn to scale.

Although the invention has been described and illustrated with respect to exemplary embodiments thereof, the foregoing and various other additions and omissions may be made therein and thereto without departing from the spirit and scope of the present invention.

What we claim is:

1. A boiler controller for determining a boiler water condition comprising:

a signal processor configured to receive signaling containing information about sets of N consecutive probe data samples related to a boiler water condition;

determine stable average signaling containing information about a stable average by averaging a set of N consecutive probe data samples in the signaling received;

determine present stable average signaling containing information about a present stable average by averaging a present set of N consecutive probe data samples in the signaling received; and determine corresponding signaling containing information about the boiler water condition, based upon whether the present stable average is within an allowable limit and a comparison of the present stable average signaling and the stable average signaling.

2. A boiler controller according to claim 1, wherein the signal processor is configured to determine if the present stable average is within the allowable limit, then if so increment a stable water counter and rewrite the stable average signaling with the present stable average signaling, else if not so declare a foam condition as the boiler water condition and reset the stable water counter.

3. A boiler controller according to claim 1, wherein the signal processor is configured to repeat for M sets of the N consecutive probe data samples the following:

determine if the present stable average is within the allowable limit based upon the comparison of the present stable average signaling and the stable average signaling; and if the present stable average is within the allowable limit, then increment a stable water counter, and rewrite the stable average signaling with the present stable average signaling, else declare a foam condition and reset the stable water counter.

4. A boiler controller according to claim 3, wherein the signal processor is configured to determine if any data sample is out of the allowable limits (+/−) while comparing the present stable average and the stable average, then reset the stable water counter to start counting from 0.

5. A boiler controller according to claim 4, wherein the signal processor is configured, once the stable water counter reaches to a count "M", to set a new foam threshold as a last average data plus an offset.

6. A boiler controller according to claim 5, wherein the signal processor is configured, once the water is stable, to sense with a probe new consecutive probe data samples and verify if any crosses the new foam threshold and to start a present foam algorithm only if this condition is satisfied.

7. A method for determining a boiler water condition comprising:

receiving in a signal processor signaling containing information about sets of N consecutive probe data samples related to a boiler water condition;

determining in the signal processor stable average signaling containing information about a stable average by averaging a set of N consecutive probe data samples in the signaling received;

determining in the signal processor present stable average signaling containing information about a present stable average by averaging a present set of N consecutive probe data samples in the signaling received; and determining corresponding signaling containing information about the boiler water condition, based upon whether the present stable average is within an allowable limit and a comparison of the present stable average signaling and the stable average signaling.

8. A method according to claim 7, wherein the method comprises determining if the present stable average is within the allowable limit, then if so incrementing a stable water counter, and rewriting the stable average signaling with the present stable average signaling, else if not so declaring a foam condition as the boiler water condition and resetting the stable water counter.

9. A method according to claim 7, wherein the method comprises repeating for M sets of the N consecutive probe data samples the steps of:

determining in the signal processor if the present stable average is within the allowable limit based upon the comparison of the present stable average signaling and the stable average signaling; and if the present stable average is within the allowable limit, then incrementing a stable water counter and rewriting the stable average signaling with the present stable average signaling, else declaring a foam condition and resetting the stable water counter.

10. A method according to claim 9, wherein the method comprises configuring the signal processor to determine if any data sample is out of the allowable limits (+/−) while comparing present average and stable average, then if so resetting the stable water counter to start counting from 0.

11. A method according to claim 10, wherein the method comprises configuring the signal processor, once the stable water counter reaches to a count "M", to set a new foam threshold as a last average data plus an offset.

12. A method according to claim 11, wherein the method comprises configuring the signal processor, once the water is stable, to sense with probe new consecutive probe data samples and verify if any crosses the new foam threshold and to start a present foam algorithm only if this condition is satisfied.

13. A boiler controller according to claim 1, wherein the boiler controller comprises a memory;

the signal processor is configured to store the stable average signaling and the present stable average signaling in the memory.

14. A boiler controller according to claim 1, wherein the signal processor is configured to determine the corresponding signaling as part of a dynamic water quality check.

15. A boiler controller for determining a boiler water condition, comprising:

a signal processor configured to receive signaling containing information about sets of N consecutive probe data samples related to a boiler water condition;

determine stable average signaling containing information about a stable average by averaging a set of N consecutive probe data samples in the signaling received and setting the stable average as a foam threshold;

determine present stable average signaling containing information about a present stable average by averaging a present set of N consecutive probe data samples in the signaling received;

determine corresponding signaling containing information about the boiler water condition, based upon whether the present stable average is within an allowable limit and a comparison of the present stable average signaling and the stable average signaling;

repeat for M sets of the N consecutive probe data samples the following:

determine if the present stable average is within the allowable limit based upon the comparison of the present stable average signaling and the stable average signaling, and if the present stable average is within the allowable limit, then increment a stable water counter, and rewrite the stable average signaling with the present stable average signaling, else declare a foam condition and reset the stable water counter;

determine if any data sample is out of the allowable limits (+/−) while comparing the present stable average and the stable average, then reset the stable water counter to start counting from 0;

once the stable water counter reaches to a count "M", set a new foam threshold as a last stable average plus an offset; and once the water is stable, provide control signaling to sense with a probe three or more consecutive probe data samples and verify if any consecutive probe data sample crosses the foam threshold, and start a present foam algorithm only if this condition is satisfied.

16. A boiler controller according to claim 15, wherein the boiler controller forms part of a steam boiler system having a steam boiler with a probe to sense probe data samples.

17. A boiler controller according to claim 16, wherein the signal processor is configured to provide control signaling to cause the probe to sense the probe data samples.

* * * * *